US010681454B2

(12) United States Patent
Barry

(10) Patent No.: US 10,681,454 B2
(45) **Date of Patent: *Jun. 9, 2020**

(54) HUMAN-EAR-WEARABLE APPARATUS, SYSTEM, AND METHOD OF OPERATION

(71) Applicant: Christopher Robert Barry, Philadelphia, PA (US)

(72) Inventor: Christopher Robert Barry, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/139,069

(22) Filed: Sep. 23, 2018

(65) Prior Publication Data

US 2019/0037302 A1 Jan. 31, 2019

Related U.S. Application Data

(63) Continuation of application No. 15/491,334, filed on Apr. 19, 2017, now Pat. No. 10,129,634.

(51) Int. Cl.

| | |
|---|---|
| ***H04R 1/10*** | (2006.01) |
| ***H04R 1/24*** | (2006.01) |
| ***H04R 11/02*** | (2006.01) |
| ***H04R 25/00*** | (2006.01) |

(Continued)

(52) U.S. Cl.

CPC ..... *H04R 1/1091* (2013.01); *F04B 33/00* (2013.01); *F04B 45/04* (2013.01); *F04B 45/045* (2013.01); *H04R 1/105* (2013.01); *H04R 1/1008* (2013.01); *H04R 1/1016* (2013.01); *H04R 1/1058* (2013.01); *H04R 1/24* (2013.01); *H04R 11/02* (2013.01); *H04R 25/604* (2013.01); *H04R 25/652* (2013.01); *H04R 1/1025* (2013.01);

(Continued)

(58) Field of Classification Search

CPC .. H04R 1/1091; H04R 1/1008; H04R 1/1016; H04R 1/105; H04R 1/1058; H04R 1/24; H04R 1/1025; H04R 25/604; H04R 25/602; F04B 45/04

See application file for complete search history.

(56) References Cited

U.S. PATENT DOCUMENTS

2009/0099677 A1* 4/2009 McBagonluri ..... H04R 25/652 700/103

FOREIGN PATENT DOCUMENTS

WO WO-2012007508 A2 * 1/2012 ..... H04R 1/1016
WO WO-2015179975 A1 * 12/2015 ..... H04R 1/1016

* cited by examiner

*Primary Examiner* — Sunita Joshi
(74) *Attorney, Agent, or Firm* — Axenfeld Law Group, LLC; Robert R. Axenfeld, Esq.

(57) ABSTRACT

Described is a human-ear-wearable apparatus having a housing, which contains electronic and auditory components for conveying sound into a human hear. An inflatable mounting system is configured to secure the housing to the human ear. The mounting system includes an elastomeric bladder configured to inflate into a customizable counterpart shape of portions of the user's Concha and Meatus areas of a particular user's ear. A pump, coupled to the housing, is configured to pass air through an opening in the housing to the elastomeric bladder. Inflation of the bladder, via the pump, is controllable by a user to form a customized fit of the mounting system's bladder to the Concha and Meatus areas of the user's ear. One or more speakers may be encased in the elastomeric bladder. For example, a dual-hybrid speaker arrangement is described with a cone speaker and a balanced-armature driver embedded in the bladder.

18 Claims, 18 Drawing Sheets

(51) Int. Cl.
*F04B 33/00* (2006.01)
*F04B 45/04* (2006.01)

(52) U.S. Cl.
CPC ..... *H04R 25/602* (2013.01); *H04R 2225/025* (2013.01)

HUMAN-EAR-WEARABLE APPARATUS, SYSTEM, AND METHOD OF OPERATION

CROSS REFERENCE TO RELATED APPLICATIONS

This application is a continuation of prior application Ser. No. 15/491,334 filed 19 Apr. 2017.

BACKGROUND

Consumers of wearable audio devices often find that the devices—such as headsets or earbuds—are uncomfortable, especially when worn over extended periods of time.

For instance, headsets are bulky, intrusive, and cover the ears with muffs. Most headsets require use of a headband to hold the ear muffs onto the ears. These headbands add to the overall bulkiness of the design, and apply constant pressure to the ears and head that often causes discomfort over time. Most headset-style systems are not used by people with hearing disabilities due to their bulk, the discomfort of wearing them over time, and the fact that they are not discreet.

Other wearable audio devices are inserted into a user's ear canal, such as earbuds. Most earbuds are round, and made of a hard plastic that may not fit in everyone's ears. Because ear buds are generally "one size fits all" and round, they don't tend to fit evenly inside the ear canal. Thus, most earbuds exert pressure on certain points in a user's ear canal walls, which can cause soreness. Additionally, because earbuds do not fit well inside the ear, they often fall out of a user's ears, or must be frequently readjusted.

Hearing aids are also often uncomfortable to wear and are extremely expensive. In addition, most hearing aids must be fit, and calibrated in the presence of an audiologist, which adds expense, and inconvenience to the user.

While many hearing aids amplify clear sounds in an audiologist's office, hearing aids fail to amplify sounds with clarity in noisy environments, when listening to music, or when attempting to listen to a soft conversation.

In addition, hearing aids are often difficult to adjust. For instance, while some hearing aids offer different modes of operation—such as for phone usage or listening to music—these modes of operation are generally preset, and are cumbersome to activate in real time.

Further, most hearing aids are hampered in extreme weather conditions. For example, most hearing aids are not waterproof. Rain, or even sweat can damage the electronics inside a hearing aid.

SUMMARY

Described in this paper is a human-ear-wearable apparatus that addresses many of the deficiencies discussed above.

In one embodiment, a human-ear-wearable apparatus includes a housing, which contains electronic and auditory components for conveying sound into a human ear. An inflatable mounting system is configured to secure the housing to the human ear. The mounting system includes an elastomeric bladder configured to inflate into a customizable counterpart shape of portions of a particular user's Concha and Meatus areas of the user's ear. A pump, coupled to the housing, is configured to pass air through an opening in the housing to the elastomeric bladder. Inflation of the bladder, via the pump, is controllable by a user to form a customized fit of the mounting system's bladder to the Concha and Meatus areas of the user's ear. In some embodiments, electronic and auditory components are encased inside the elastomeric bladder, which is generally waterproof.

In another aspect, the housing includes a proximal-side cover configured to rest against the external human ear. The elastomeric bladder has outer walls configured to form a finger-like projectile that extends through an opening in the proximal-side cover in response to air pumped into the bladder. When air is pumped into the bladder it expands the finger-like projectile longitudinally along a length of the finger-like projectile and laterally across a width of the finger-like projectile, thereby increasing the length and width of the finger-like projectile to an inflated configuration.

So, in one embodiment, when the proximal-side cover is positioned against the human ear, and the bladder inflates in response to air pumped into the bladder, the bladder transitions from a deflated configuration to an inflated configuration, and the finger-like projectile simultaneously extends lengthwise into the auditory meatus of the human ear, and expands diametrically toward the walls of the ear canal to apply an expansive force against the walls of the ear canal.

Also, in one embodiment, an arc-shaped outer wall extends through an opening in the cover. The arc-shaped outer wall expands radially in a generally opposite direction of the finger-like projectile when the bladder is inflated with air. The arc-shaped outer wall is configured to align with a Posterior-Auricular-Sulcus area of the human ear.

So, when the proximal-side cover is positioned against the human ear, and the bladder inflates in response to air pumped into the bladder, the bladder transitions from a deflated configuration to an inflated configuration, and the arc-shaped outer wall expands to apply a force against a Posterior-Auricular-Sulcus area of the human ear.

In another aspect, a stalk extends from the housing in alignment with the Cymba area of the human ear when the mounting system is secured to the human ear. The stalk includes a microphone disposed therein for receiving voice commands from a user wearing the apparatus in the ear. The stalk is configurable to a make contact directly with skin in the Cymba area of the human ear. Because the microphone rests next to the bone of the user's skull, the microphone is able to receive auditory commands exclusively from the user.

In another aspect, the human-ear-wearable apparatus includes a midplane with an outer ring along the periphery. An elastomeric bladder, is coupled to the outer ring. The elastomeric bladder is generally coplanar to the midplane. The elastomeric bladder and the midplane are also generally spaced apart to form a first chamber for maintaining compressed air therein. A diaphragm is coupled to the outer ring on an opposite side of the midplane from the elastomeric bladder. So the midplane is sandwiched between the diaphragm and elastomeric bladder. The diaphragm is generally coplanar to the midplane. The diaphragm and the midplane are generally spaced apart to form a second chamber.

In some embodiments, the midplane includes a one-way valve extending through the midplane between the second chamber and the first chamber. The one-way valve is configured to permit air to flow from the second chamber into the first chamber, when the diaphragm is compressed.

In some embodiments, the human-ear-wearable apparatus also includes a relief valve positioned in an aperture extending through the outer ring configured to allow pressured air trapped in the first chamber to escape the first chamber.

In some embodiments, both the first and second chambers form enclosed-sealed chambers when apparatus is in steady-state use or not being used. That is the second chamber is open after the diaphragm is compressed inward (pumping air) by a user, and is returning to its original position. Likewise, first chamber is not sealed when the relief valve is opened. Otherwise, in one embodiment, both chambers are generally waterproof when not pumping or relieving air.

In some embodiments, electronic and audio components, such as one or more speakers may be located in the first chamber. Likewise, a processor may be coupled to the midplane and/or collocated in the enclosed-sealed chamber.

In various embodiments, the human-ear-wearable apparatus provides an extensible base platform upon which various audio-based input/output methodologies can be integrated in software, firmware, and hardware.

In operation, each human-ear-wearable apparatus may communicate with other human-ear-wearable apparatuses, or other devices. Further, the apparatus worn in the left and right ears may communicate with each other.

This summary is provided to introduce a selection of concepts in a simplified form that are further described below. This summary is not necessarily intended to identify key features or essential features of the claimed subject matter, nor is it necessarily intended to be used as an aid in determining the scope of the claimed subject matter.

The foregoing outlines examples of this disclosure so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

Reference herein to "one embodiment," "an embodiment," "an aspect," "an implementation," "an example," or similar formulations, means that a particular feature, structure, operation, or characteristic described in connection with the embodiment is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

In contrast.

DETAILED DESCRIPTION

Some embodiments of a human-ear-wearable apparatus may be described with reference to anatomical features of the human ear shown named in FIG. 1.

Figure 2:
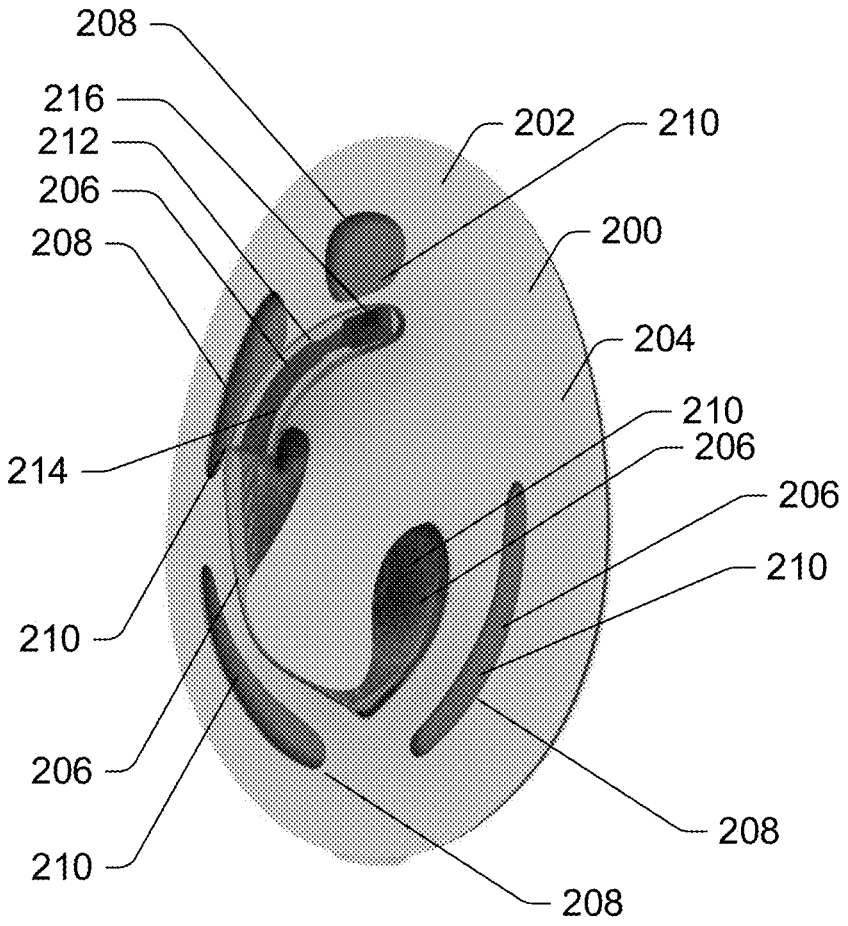
FIG. 2 is an exterior view of a proximate side of a human-ear-wearable apparatus according to an embodiment of the present disclosure.

Example Human-Ear-Wearable Apparatus (Physical Structure(s)) Example Exterior Configurations FIG. 2 is an exterior view of a proximate side (closest to the ear) of human-ear-wearable apparatus 200. In the illustrated embodiment, human-ear-wearable apparatus 200 includes a housing 202, which in the particular view of FIG. 2 includes a proximal-side cover 204. Apparatus 202 also includes a mounting system 206.

Housing 202 contains system electronics, mechanical devices, audio components, speakers, transmitters, receivers, microphones, processor(s), code, power supplies, all shown in later figures. Housing 202 provides a framework for containing these devices in a compact device able to fit, fully or partially, within the Concha-cavity area of the ear.

Proximal-side cover 204 serves as a retention cover, (i.e. a shell or cap) to the proximal-side of apparatus 200. Proximal-side cover 204 may be constructed of any suitable material that can withstand moisture, and remain comfortable near or against the skin of the ear. For instance, proximal-side cover 204 may be constructed of plastic, semi-rigid rubber, fiberglass, other suitable materials, or any combination thereof. In addition, fabric of any suitable color, texture, material, and shape can be made to fit over, or integrated as a surface of proximal-side cover 204.

Proximal-side cover 204 may include openings 208 for expansion of elements associated with mounting system 206. Mounting system 206 is configured to secure housing 202 to a human ear (such as FIG. 1).

In various embodiments, mounting system 206 includes an elastomeric bladder 210 configured to inflate into a customizable counterpart shape of areas of the Concha and Meatus of the human ear. As shown in FIG. 2, elastomeric bladder 210 is in a deflated configuration. Thus, bladder 210, is partially or fully retracted within housing 202.

In some embodiments, mounting system 206 also includes a stalk 212 extending from housing 202. Stalk 212 is configured in a curved shape for general alignment with the Cymba area of the human ear when mounting system 206 is secured to the Concha area of the human ear. In one embodiment, stalk 212 may be constructed of an elastomeric material and include an inner wire or conduit 214. In other embodiments, stalk 212 may be constructed of other materials such as coaxial wire with a plastic or rubber sheathing, or a combination of the foregoing.

Stalk 212 may include a microphone 216 disposed therein for receiving voice commands from a user wearing apparatus 200. One or more portions of stalk 212 are configured to rest against the skin of the ear in the Cymba area of the ear.

Figure 3:
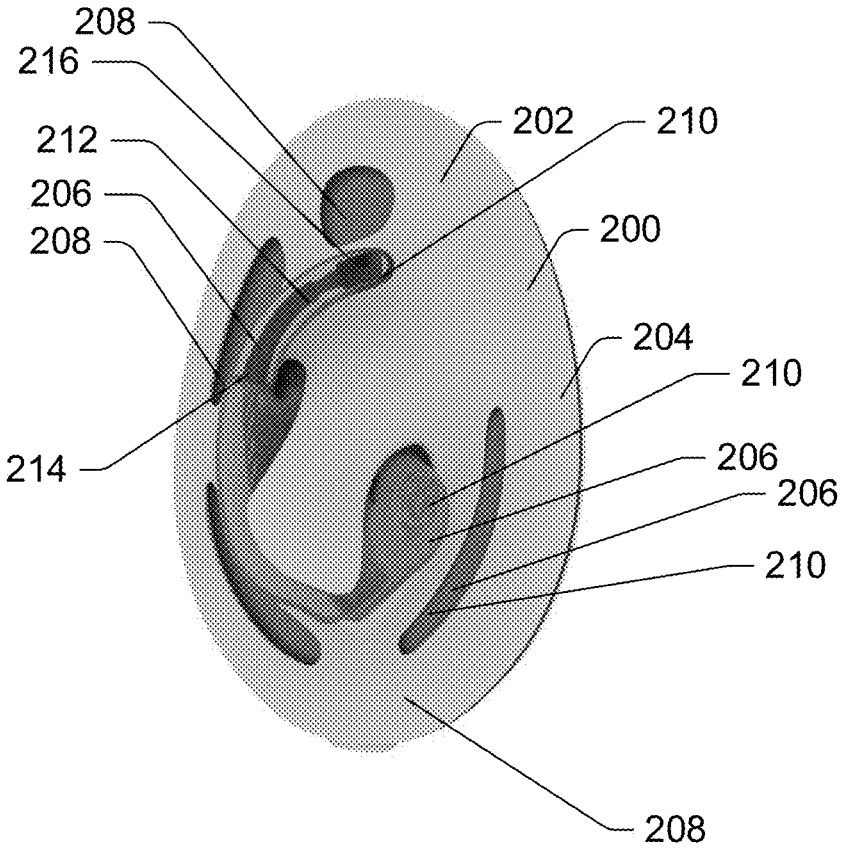
FIG. 3 shows another view of an example human-ear-wearable apparatus with an elastomeric bladder partially inflated.

FIG. 3 shows another view of apparatus 200 with elastomeric bladder 210 partially inflated.

Figure 4:
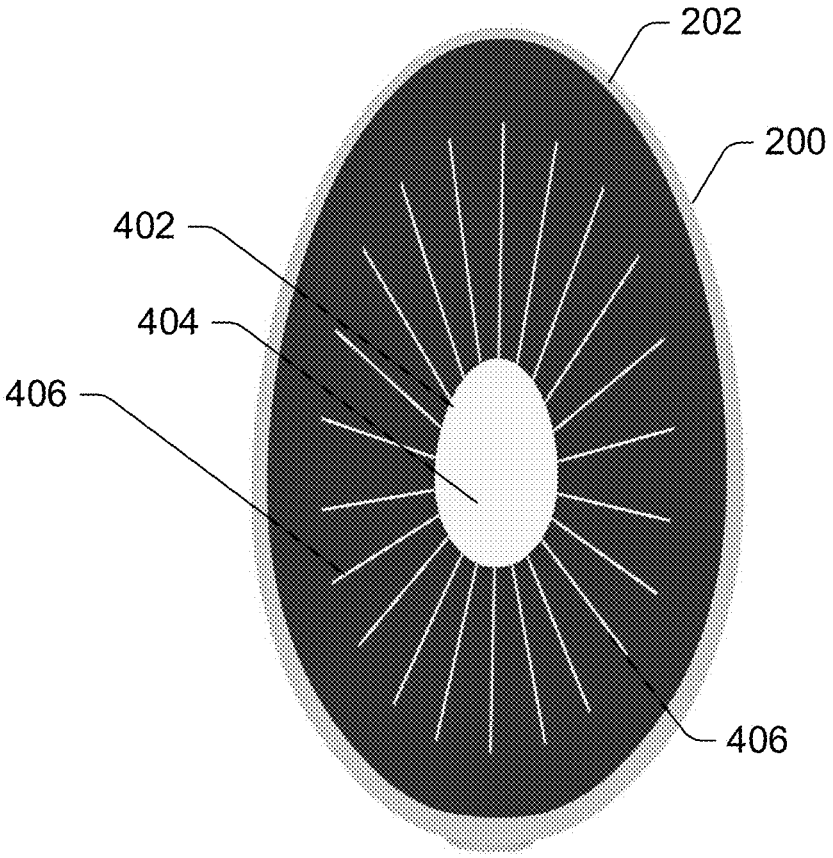
FIG. 4 is an exterior view of an opposite side of an example human-ear-wearable apparatus than shown in FIGS. 2 and 3 i.e., a distal side (away from the ear).

FIG. 4 is an exterior view of an opposite side of human-ear-wearable apparatus 200 than shown in FIGS. 2 and 3. That is, FIG. 4 shows a distal side (away from the ear). Distal side of apparatus 200 is generally planar with proximal side of apparatus 200. External skins or custom exterior shells, of any color, texture and shape may configured to fit over the outside of the distal-side of apparatus 200. Thus a user can customize the look of the device.

In the illustrated embodiment of FIG. 4, apparatus 200 includes a pump 402, coupled either directly or indirectly, to housing 202. Pump 402 is configured to pass air through a passage (not shown in FIG. 4) inside housing 202 to elastomeric bladder 210 (FIG. 2), when it central area 404 is depressed by the user. In one embodiment, pump 402 includes intake valves 406 for loading the pump with air. In one example, pump 402 may work with a duckbill intake valve (to be described). Thus central area 404 is generally resiliently flexible to allow movement of pump 402 back and forth. Inflation of bladder 210 (FIGS. 2 and 3), via the pump 402, is controllable by a user to form a customized fit of bladder 210 to the Concha and Meatus areas of the user's ear.

Figure 5:
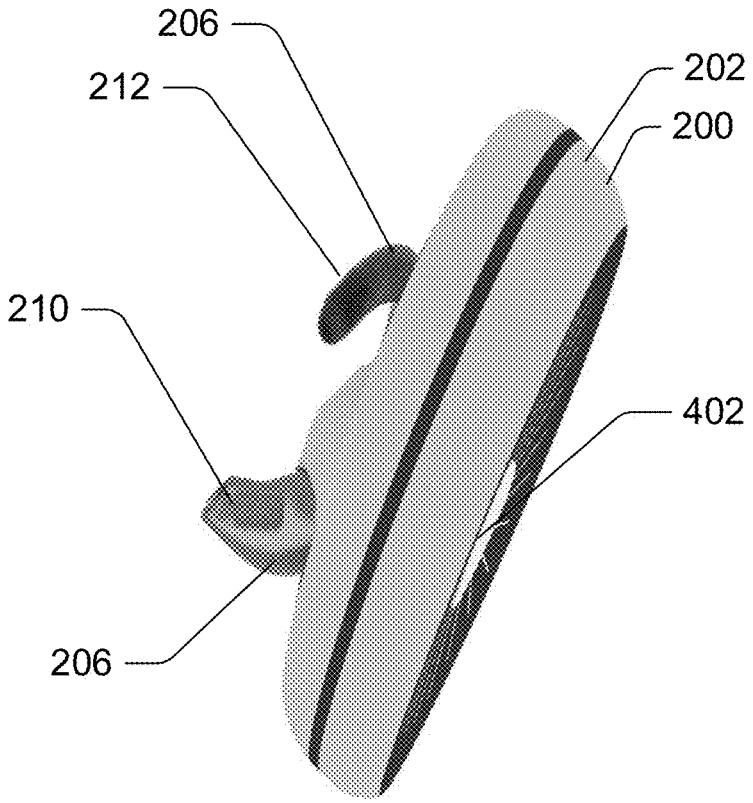
FIG. 5 is a front side view of an example human-ear-wearable apparatus showing partial views of both proximal and distal sides of the apparatus described with reference to FIGS. 2-4.

FIG. 5 is a front side view of human-ear-wearable apparatus 200 showing partial views of both proximal and distal sides of the apparatus described with reference to FIGS. 2-4. As appreciated by those skilled in the art, after having the benefit of this disclosure, although housing 202 is generally shown as circular, housing 202 may be of other sizes, and shapes, such as elliptical, square, or other configurations.

Example Mounting System

Figure 6:
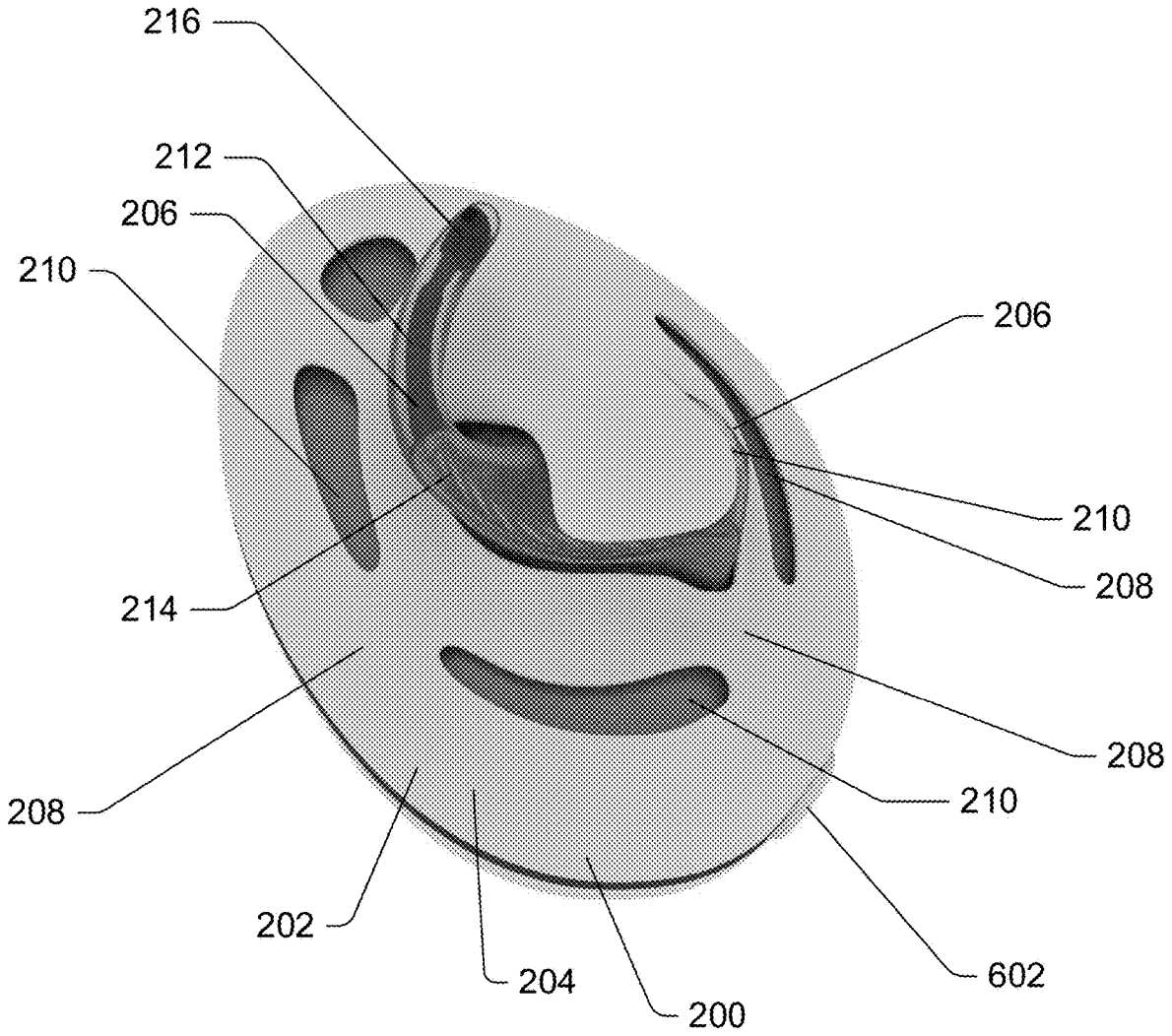
FIG. 6 illustrates a proximal-side view of a human-ear-wearable apparatus with an example elastomeric bladder in a deflated configuration.

FIG. 6 illustrates a proximal-side view of an example human-ear-wearable apparatus 200 with bladder 210 in a deflated configuration.

Figure 7:
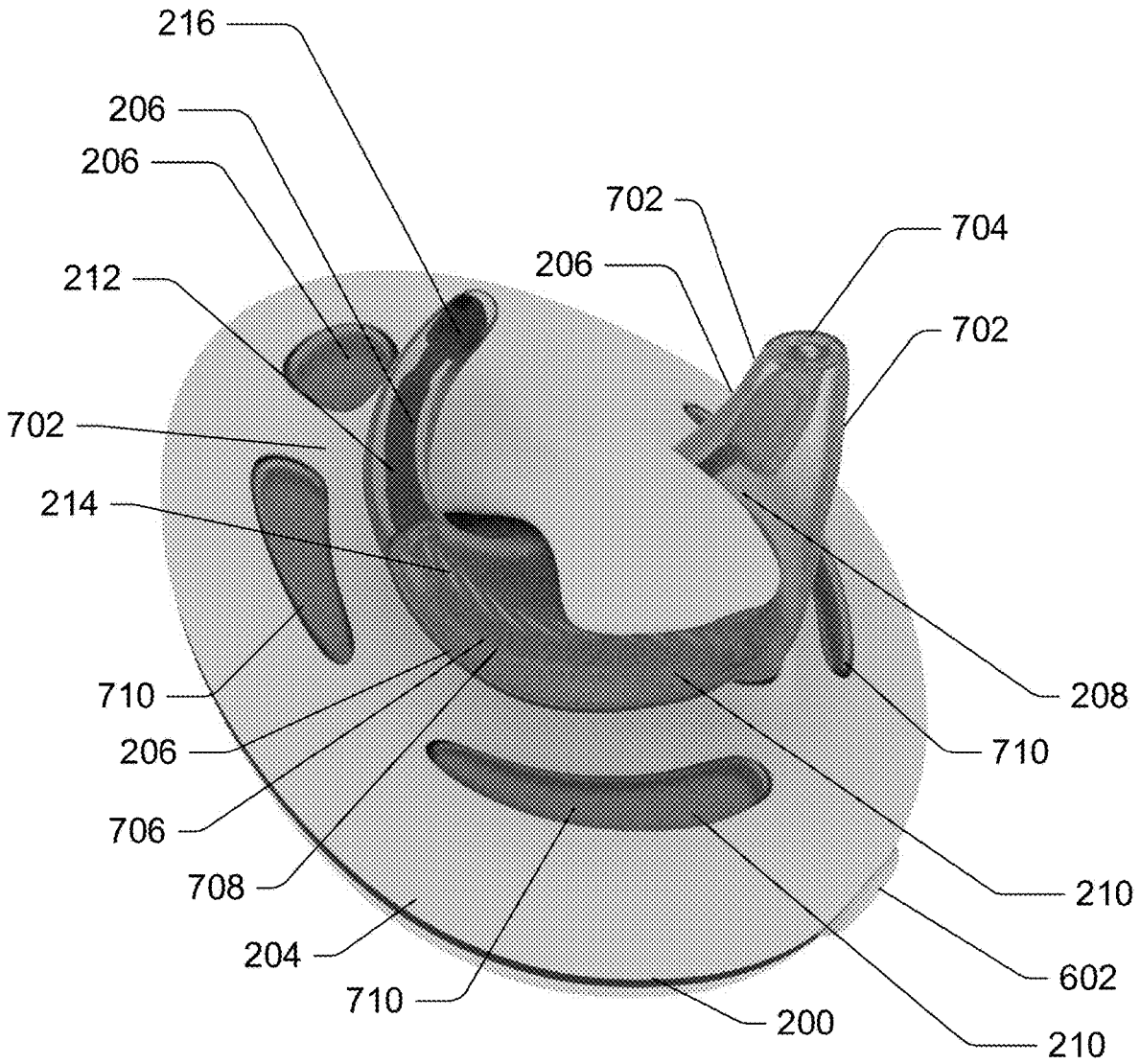
FIG. 7 illustrates a partial-cross-sectional view of the proximal side of an example human-ear-wearable apparatus with an example elastomeric bladder in an inflated configuration.

In contrast, FIG. 7 illustrates a partial-cross-sectional view of the proximal side of human-ear-wearable apparatus 200 with bladder 210 in an inflated configuration.

Referring to FIG. 7, in one embodiment, when air is pumped into bladder 210, the air pressure expands a finger-like projectile 704 longitudinally along a length of finger-like projectile 704 and laterally across a width of the finger-like projectile 704 thereby increasing the length and width of finger-like projectile 704 to an inflated configuration.

That is, when inflated, elastomeric bladder 210 has outer walls 702, which form finger-like projectile 704 that extends through an opening 208 in proximal-side cover in response to air pumped into bladder 210 by pump 402 (FIG. 4).

Figure 1:
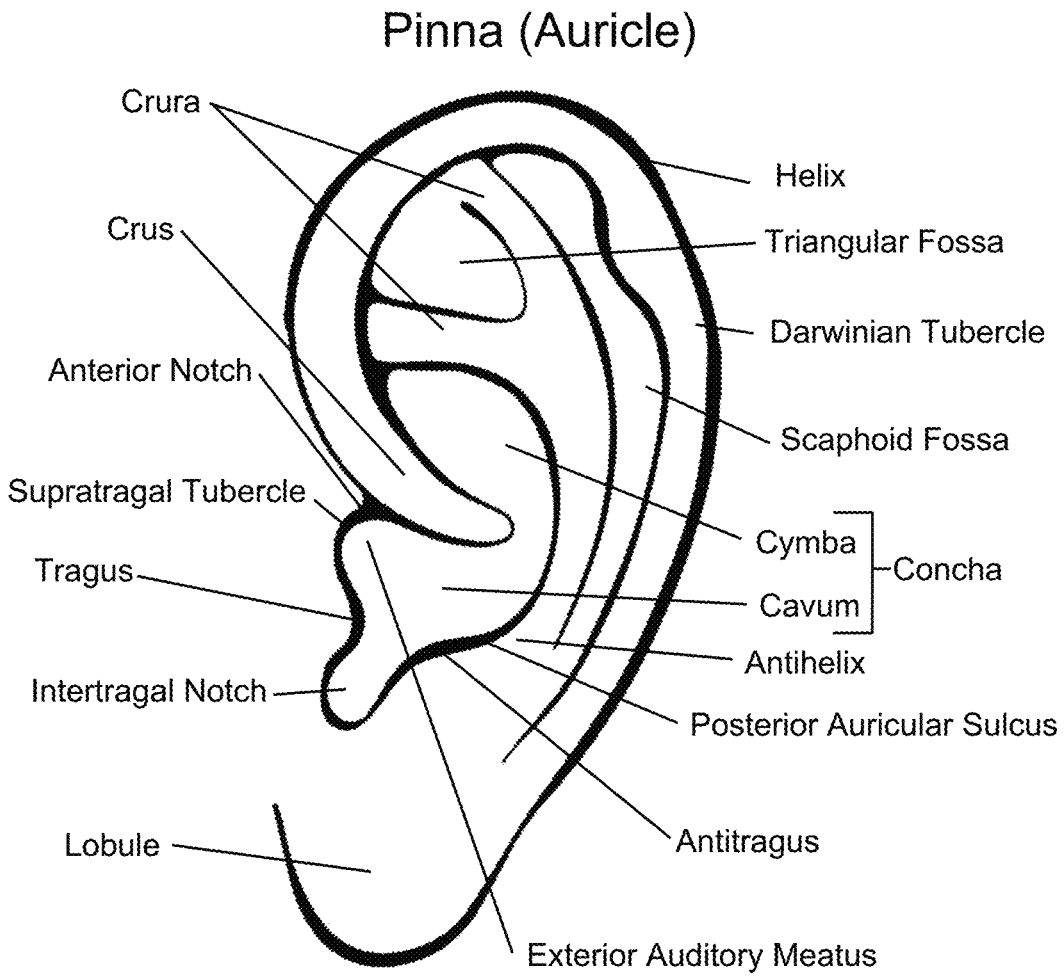
FIG. 1 shows anatomical features of the human ear.

So when proximal-side cover 204 is positioned against a human ear (such as shown in FIG. 1), and bladder 210 inflates in response to air pumped into bladder 210. That is, bladder 210 unfurls and transitions from a deflated configuration (FIG. 6) to an inflated configuration (FIG. 7), and finger-like projectile 704 forms, and extends lengthwise into the auditory meatus of the human ear, and also expands diametrically (widthwise) toward the walls of the ear canal to apply an expansive force against the walls of the ear canal.

In one embodiment, as elastomeric bladder 210 inflates, finger-like projectile 704 unfurls, i.e., unrolls out of itself, coaxially into the ear canal. This motion may reduce friction experienced by a user as the bladder material is stretched along the surface of the ear's skin.

Referring to FIG. 7, in one embodiment, mounting system 206 also includes a second location 706 to the ear when bladder 210 is inflated. Specifically, an arc-shaped outer wall 708 extends through an opening 208 in cover 204, and expands radially in a generally opposite direction (i.e., approximately 120 degrees in the opposite direction) of finger-like projectile 704 when the bladder 210 is inflated with air. As appreciated by those skilled in the art after having the benefit of this disclosure, the exact angle offset between arc-shaped outer wall 708 and finger-like projectile 704 may be less than or more than 120 degrees.

Arc-shaped outer wall 708 is configured to align with a posterior-auricular-sulcus area (see FIG. 1) of the human ear.

So when proximal-side cover 204 is positioned against the human ear, and bladder 210 inflates in response to air pumped into the bladder from pump 402 (FIG. 4), bladder 210 transitions from a deflated configuration (FIG. 6) to an inflated configuration (FIG. 7). During this transition arc-shaped outer wall 708 (FIG. 7) expands to apply a force against a posterior-auricular-sulcus area (FIG. 1) of the human ear.

Thus, elastomeric bladder 210 forms two counter opposing mounting mechanisms (finger-like projectile 704 and arc-shaped outer wall 708) to secure housing 202 to a human ear. A user operating pump 402 can configure an optimal-outer dimension of these walls for an optimal fit that is customized to his or her specific ear configuration.

In some embodiments, when elastomeric bladder 210 is inflated, it may also expand beyond a surface of proximal-side cover 204 in openings 710 (FIG. 7) around the periphery of cover 204. This provides padding against the skin of the ear, passive radiators for enhancing bass response, and aids in enhancing the transmission of sound into the surface of the Pinna.

In some embodiments, these portions of expanded bladder 210 at openings 710 vibrate at approximately 180 degrees out of phase with a woofer cone's (to be described) primary proximal side, and provide a richer and more immersive audio experience.

After bladder 210 is inflated, mounting system 206 may be decoupled from a human ear by deflating elastomeric bladder 210. In one embodiment, a valve pressure release mechanism 602 (FIGS. 6 and 7) is configured to allow a user to control and selectively release pressure from bladder 210. Release valve 602 will be described in more detail below.

Figure 8:
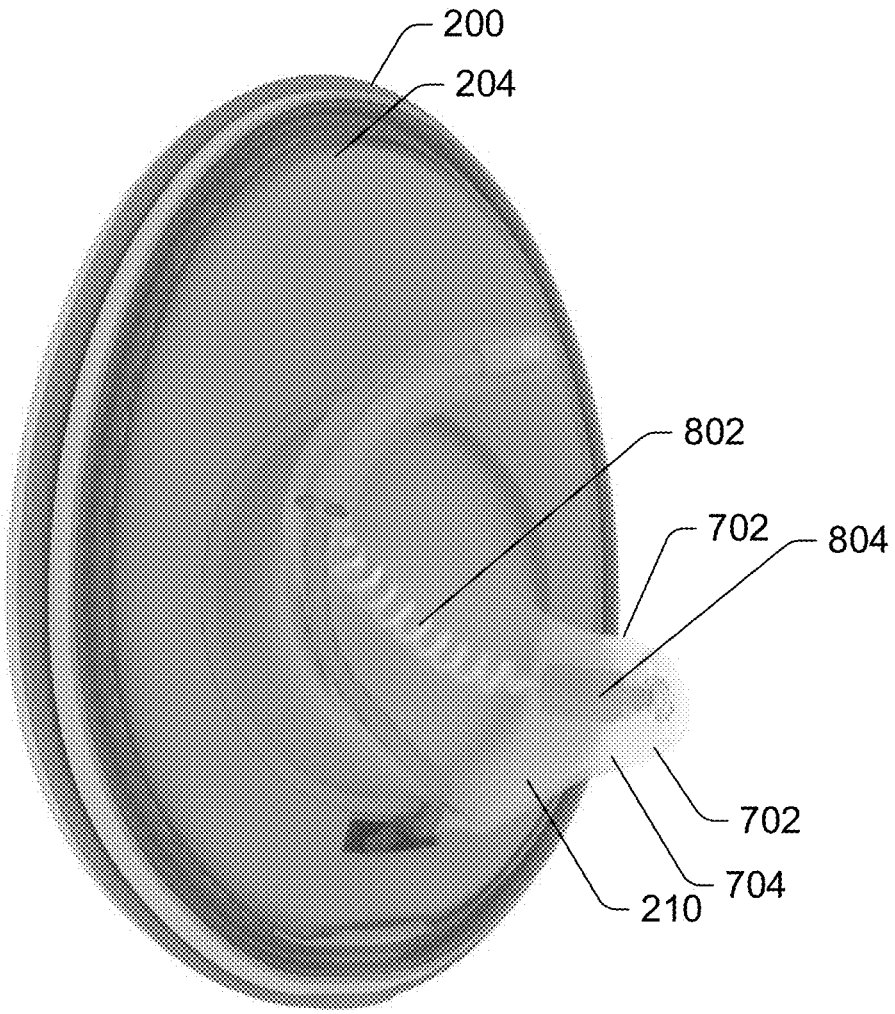
FIG. 8 shows a transparent view of portions of the proximal side of an example human-ear-wearable apparatus.

FIG. 8 shows a transparent view of portions of the proximal side of apparatus 200. In one embodiment, a resilient member 802 disposed in bladder 210, and specially finger-like projectile 704, is configured help retract finger-like projectile 704 to a substantially decreased length (such as shown in FIG. 6) when bladder 210 is deflated, and/or transitions to a deflated configuration.

In the illustrated embodiment of FIG. 8, resilient member 802 is a coiled wire. However, as appreciated by those skilled in the relevant art, after having the benefit of this disclosure, resilient member 802, may be other devices which provide a retraction force to cause bladder to retract, such as a spring, and a stretched length elastomeric cord. In addition, portions of bladder 210, and finger-like projectile 704 may be sheathed in a coiled thermoplastic material that exhibits a spring behavior for retracting finger-like projectile 704.

In sum, aspects of the present disclosure include attachment mechanisms that feature several improvements over current attachment mechanisms for attaching human-ear-wearable apparatuses to the ear.

Exemplary Speaker Mounted in Finger-Like Projectile

As shown in FIG. 8, a speaker 804 may be mounted at a distal end of finger-like projectile 704 inside walls 702 of elastomeric bladder 210. In one embodiment, speaker 804 is a balanced armature driver. as appreciated by those skilled in the relevant art, after having the benefit of this disclosure speaker 804 may be other types of speaker devices. Resilient member 802 (i.e., in the illustrated embodiment is a recoiling wire) provides an electrical conduit to speaker 804.

Exemplary Midplane and Internal Configurations

Figure 9:
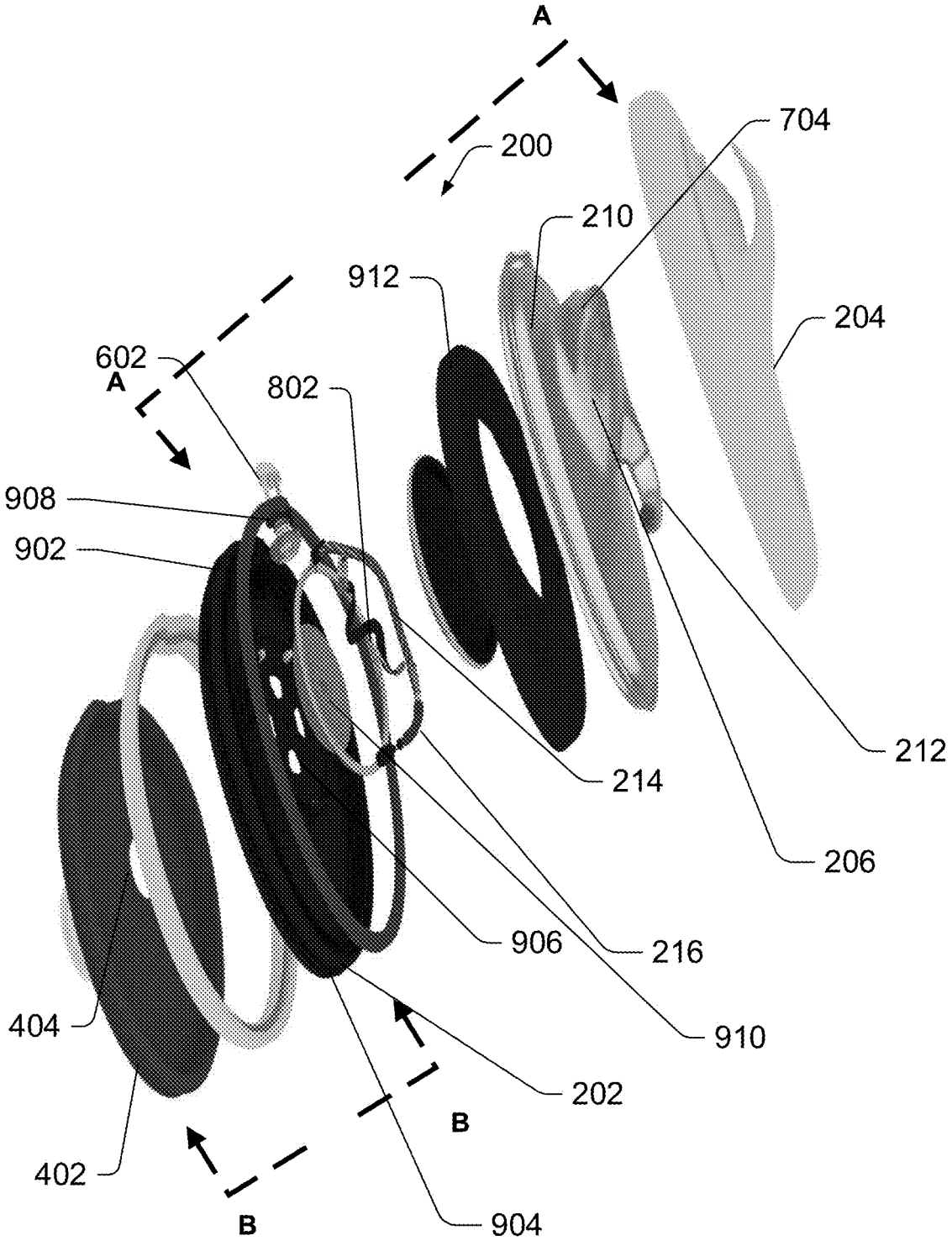
FIG. 9 shows an exploded view of an example human-ear-wearable apparatus.

FIG. 9 shows an exploded view of human-ear-wearable apparatus 200. Referring to FIG. 9, as shown as part of housing 202, human-ear-wearable apparatus 200 includes a midplane 902 with an outer ring 904 along the periphery.

In various embodiments, midplane 902 is a planar central component of apparatus 200 that provides overall structure for apparatus 200. Midplane 902 may also provide a mounting mechanism for various internal components, such as speakers, electrical components, air relief and passage valves, electronic pass-through vias, microphones for receiving ambient sound, and electronic boards.

Elastomeric bladder 210, is configured to connect to outer ring 904. Elastomeric bladder 210 is generally coplanar to midplane 902. When connected, elastomeric bladder 210 and midplane 902 are generally spaced apart to form an enclosed-sealed chamber (referred to as the first chamber) (denoted at brackets A-A) for maintaining compressed air therein.

Diaphragm (or pump) 402 is coupled to outer ring 904 on an opposite side of the midplane 902 from elastomeric bladder 210. So midplane 902 is sandwiched between diaphragm 402 and elastomeric bladder 210. Diaphragm 402 is generally coplanar to the midplane 904. Diaphragm and the midplane are generally spaced apart to form a second chamber (denoted as bracket B-B) in FIG. 9.

In some embodiments, midplane 902 includes one or more one-way valve(s) 906 extending through midplane 902 between second chamber (B-B) and the enclosed-sealed chamber (A-A). Each one or more one-way valve(s) 906 are configured to permit air to flow from second chamber (B-B) into the first chamber (A-A), when diaphragm 402 is compressed.

Thus, midplane 902 may be capped on both sides (sandwiched between) elastomeric bladder 210 and diaphragm (pump) 402.

Still referring to FIG. 9, in some embodiments, human-ear-wearable apparatus 200 also includes a relief valve 602 positioned in an aperture 908 extending through outer ring 904 configured to allow pressurized air trapped in the first chamber (A-A) to escape the first chamber (A-A).

In some embodiments, electronic and audio components, such as one or more speakers 910 may be located in the first chamber (A-A). For instance, in the illustrated embodiment of FIG. 9, a speaker 910 (such as a headphone-sized cone driver (woofer)) may be directly or indirectly mounted to midplane 902. Speaker 910 may provide the main volume of sound emanating through bladder 210 to a user's ear.

In one embodiment, apparatus 200 may include dual speakers (cone and balanced armature) positioned in bladder 210. Specifically, both a large diameter cone-type speaker 910 in the main volume of bladder 210, as well as a small, balanced armature type speaker 804 (FIG. 8) deep (distal end) in the meatus area (finger-like projectile) of bladder 210.

A power source, such as Li-ion battery 912 may be directly or indirectly mounted to midplane 902. In one embodiment, battery 912 may be shaped to the interior shape of midplane 902.

An electronic circuit board (not shown in FIG. 9) may also be mounted, directly or indirectly, to midplane 902, either in first chamber (A-A), in the second chamber (B-B), and or on both sides of midplane 906. The electronic circuit board (not shown in FIG. 9) may consist of an embedded computer system (CPU and associated integrated circuits, memory, persistent storage, ADC/DAC, voice command ASIC, Bluetooth, other wireless devices, and capability, various other sensor capabilities, and USB storage).

Likewise, a processor including circuitry may be coupled to the midplane and/or collocated in the enclosed-sealed chamber.

Figure 10:
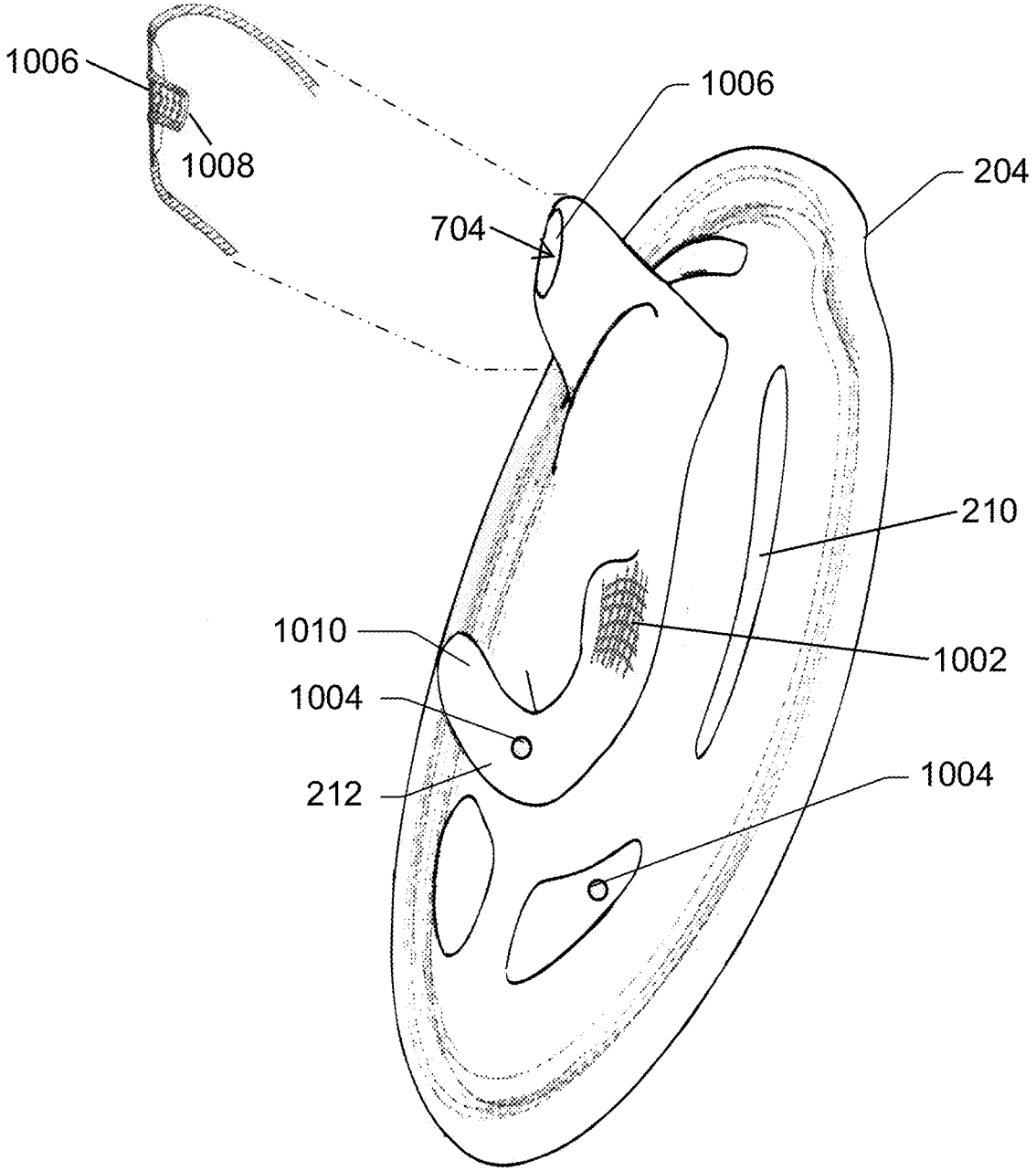
FIG. 10 is a perspective view of an example elastomeric bladder, which is ear-cavity shaped configured to inflate and fit completely in the Concha, Meatus, and Cymba areas of the human ear.

Various example features, and elements shown and illustrated in FIGS. 2-9 will now be described in more detail as follows:

FIG. 10 is a perspective view of an example elastomeric bladder 210, which is ear-cavity shaped configured to inflate and fit completely in the Concha, Meatus, and Cymba areas of the human ear, thereby providing a secure and comfortable mounting anchor to hold apparatus 200 in the ear. In the illustrated embodiment, bladder 210 is partially covered by proximal-side cover 204. As appreciated by those skilled in the art after having the benefit of this disclosure, bladder 210 and proximal-side cover 204 may be a discrete elastomeric-bladder and retention cover. That is, cover 204 and bladder (or multiple bladders, which are location specific) 210 may be co-molded into a single cover component using two or more elastomers of approximately differing characteristics.

To enhance the control over the inflation geometry of bladder 210, various shapes and types of fabrics 1002 may be adhesively affixed or molded into various locations within bladder 210. These fabrics can be of any suitable material, and may be woven or nonwoven in structure. These fabrics may also be electrically conductive and work in concert with an embedded sensor(s) 1004.

For instance, in various embodiments, integral to the skin of the bladder, a plethora of electromagnetic sensors 1004 may be embedded or adhesively affixed, providing human body metrics, such as temperature, heart rate, and/or biometric security information, such as blood vessel patterning analysis and verification, inter-embedded sensor data such as ear-dimensional data based on electromagnetic values of other related sensors when in place in an authorized ear.

Still referring to FIG. 10, in various embodiments, the meatus tip area 1006 of bladder 210 may be fabricated of a stiffer elastomeric, film, fabric, or plasticized paper-like material membrane, either continuous, woven, or non-woven in structure, to enhance sound transmission. While the balanced armature radiates sound through the center section of this bladder tip 1006, the surrounding region is designed to aid sound transmission from the larger cone driver through the compressed air volume of the bladder, and first chamber (A-A) (shown in FIG. 9).

Integrated into bladder tip 1006 is the small balanced armature elastomeric retention cup 1008 for holding the driver deep within the meatus area of the ear. The speaker mounts into, and is suspended at a center axis of the bladder meatus tip 1006.

In various embodiments, as the bladder shape changes into the Cymba section of stalk 212, it becomes a solid material (shown as 1010), which may be a stiffer elastomeric co-molded with bladder 210 itself. In one embodiment, a coaxial wire 214 in stalk 212 which is retained inside bladder 210, makes it's electrical connection in a coaxial connector molded inside stalk 212 (see i.e. FIGS. 2 and 6). The connector distributes its connections to either two or three externally accessible simple connectors formed in a socket facing the proximal side of the device. Into this socket is plugged a waterproof mems microphone 216 which makes contact to the wearer's skin within the Cymba area of the ear for command and communication audio input.

Figure 11:
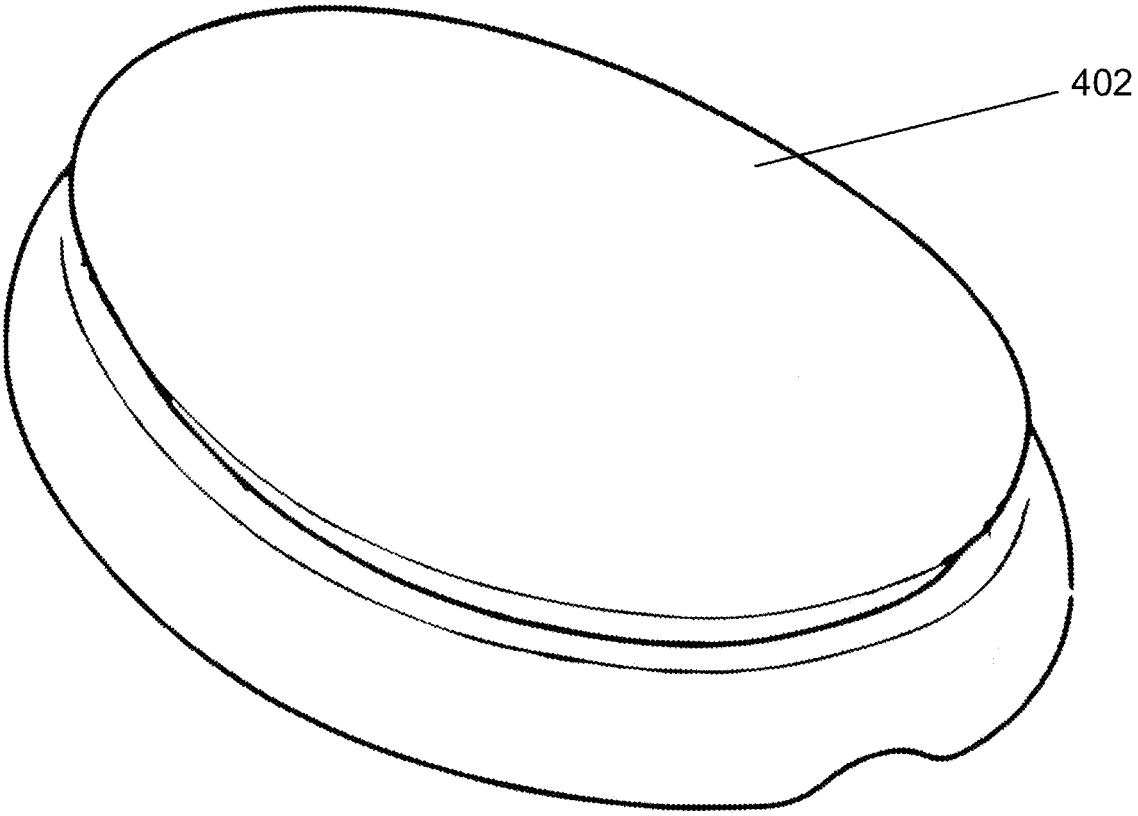
FIG. 11 shows an exterior perspective view of diaphragm (pump) (see also FIG. 4).
Figure 12:
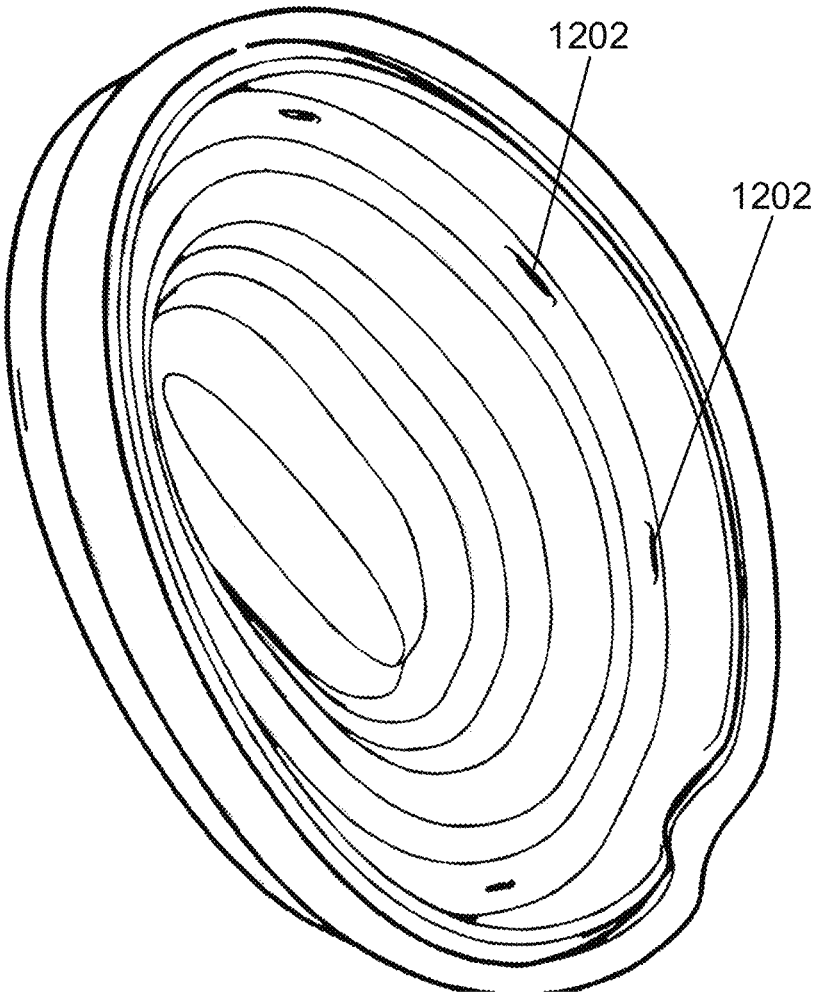
FIG. 12 shows an interior perspective view of diaphragm (pump).

FIG. 11 shows an exterior perspective view of diaphragm (pump) 402 (see also FIG. 4). FIG. 12 shows an interior perspective view of diaphragm (pump) 402. With reference to FIGS. 11 and 12, in some embodiments, diaphragm 402 uses an integrated bellows for inflating the bladder through midplane 902 (FIG. 9). For instance, in one embodiment, diaphragm 402 has integrated duckbill-style elastomeric intake valves 1202 for loading the pump with air.

To close and seal the diaphragm and secure the intake valves to make the system waterproof, the face of the pump (FIG. 11) presses in to tightly seal to the diaphragm cover, and then the face overcenters (e.g. presses in such that it passes through a planar orientation to a concave orientation) to lock into place. This leaves the face in a slightly concave orientation, whereby it's outer edge is compressed against and secured to the inside rim of the diaphragm cover.

Figure 13:
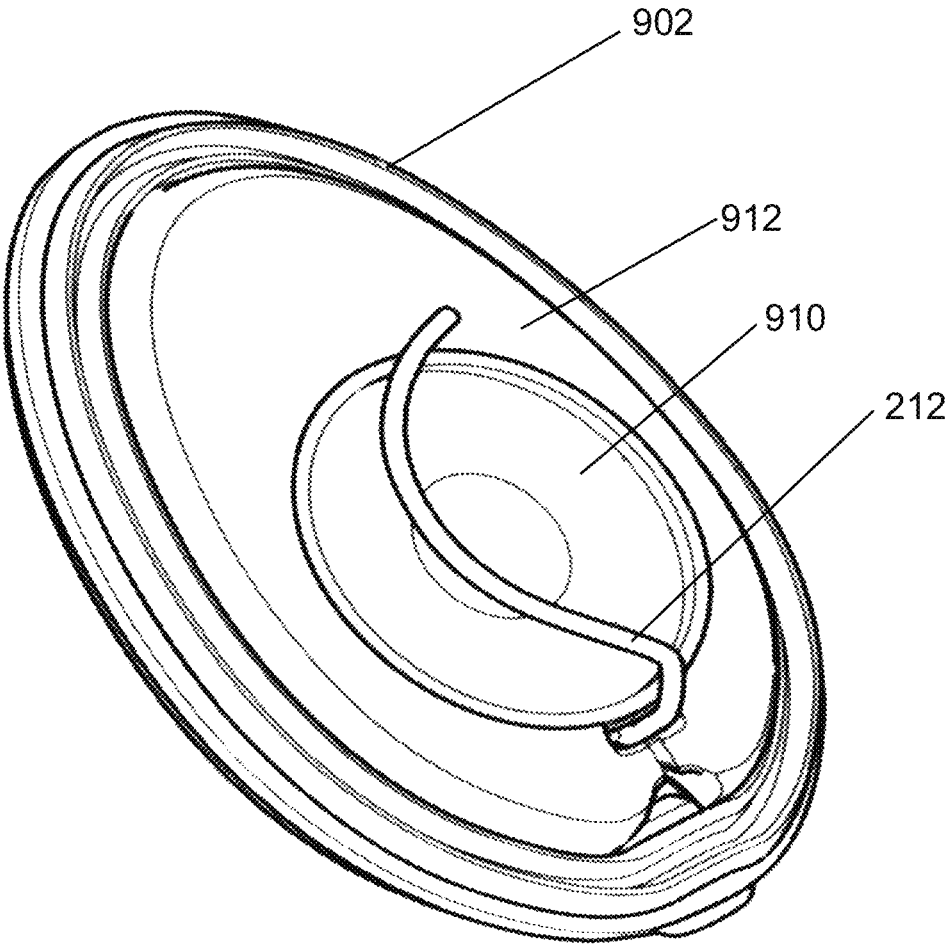
FIG. 13 shows a perspective view of an example midplane.

FIG. 13 shows a perspective view of midplane 902. As shown, midplane is the primary structural element of the system, and provides the physical separation of the compressor (e.g. air compressor) (second chamber) (B-B) (FIG. 9) and compressed regions (e.g., bladder side) (first chamber) (A-A) FIG. 9) of the pneumatic system. For instance, referring to FIG. 12, in one embodiment, midplane 902 provides mechanical mounting purchase to the speaker 910, battery 912, wire mic stalk 212, and electronic components of the system.

Figure 14:
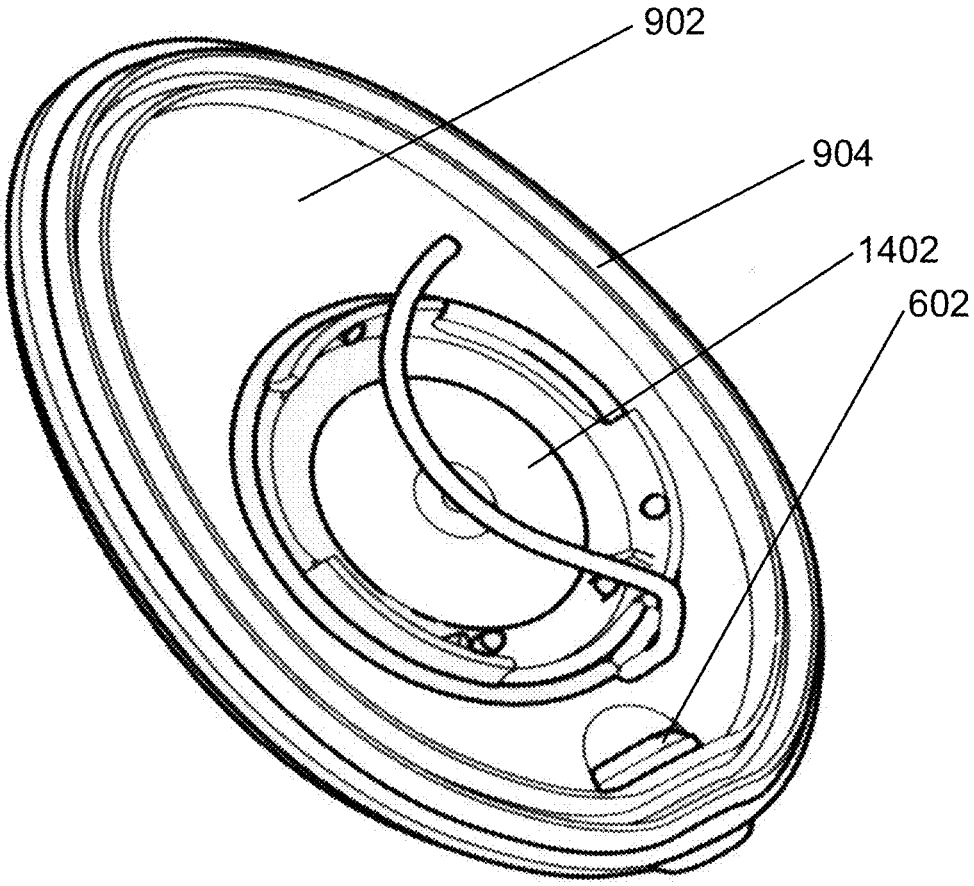
FIG. 14 shows another perspective view of an example midplane.

FIG. 14 shows another perspective view of example midplane 902. In this illustrated embodiment, midplane 902 vis-à-vis outer ring 904 provides the mechanical connection and sealing interfaces for the bladder and diaphragm components. An elastomeric compression valve 1402, and relief valve 602 is mounted to midplane 902.

In one embodiment, relief valve 602 provides a mechanism for the controlled and selective relief of pressure from/in the bladder by precisely lifting the sealing edge of an elastomeric umbrella relief valve. Leverages the stem of the valve as the provider of spring pressure against the relief button, negating the need for an additional spring device.

Figure 15:
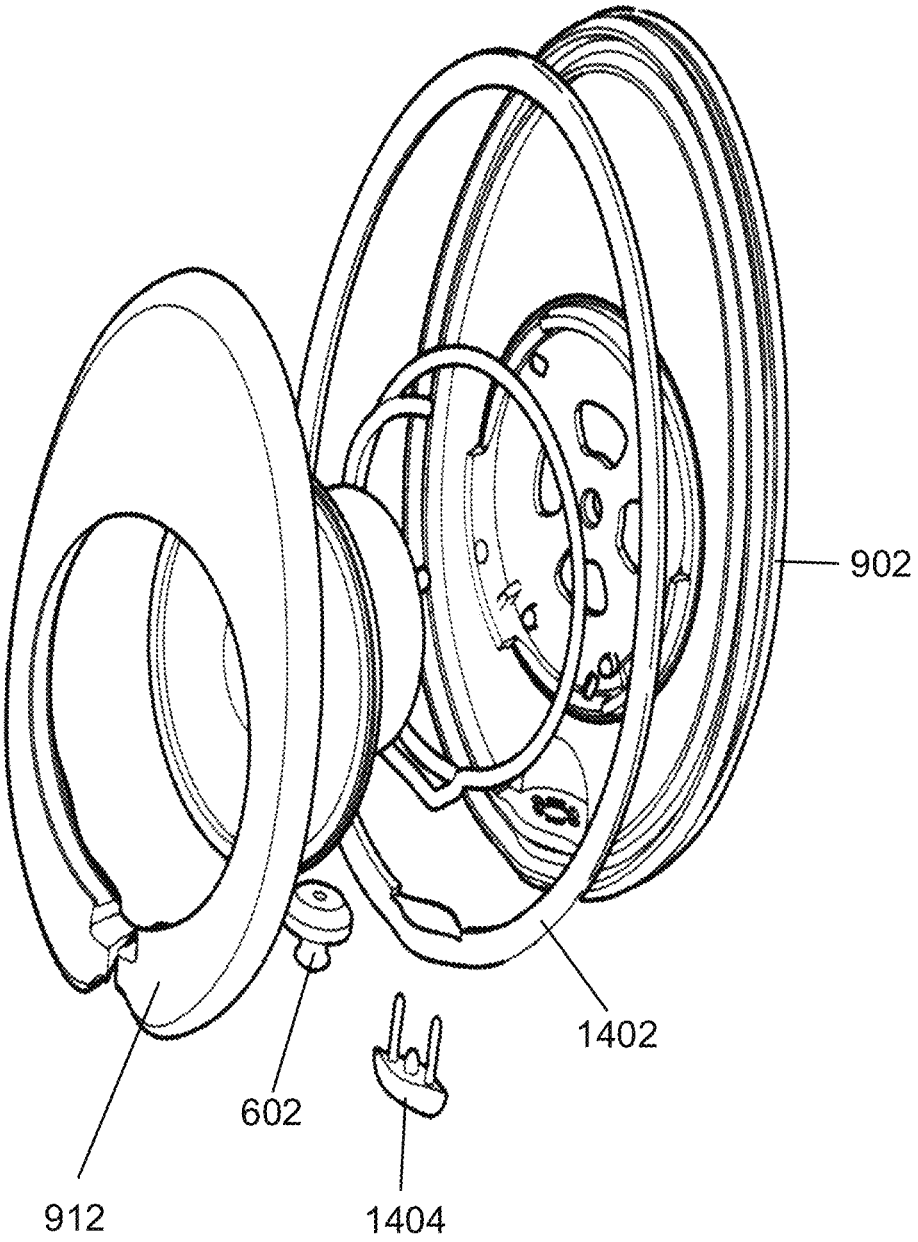
FIG. 15 shows an exploded view of various example parts associated with the relief valve system, including an umbrella relief valve, and a relief button.

FIG. 15 shows an exploded view of various example parts associated with the relief valve system, including an umbrella relief valve 602, and a relief button 1404. Referring to FIG. 15, other elements associated with packaging for apparatus 200 include a gasket 1402 for encircling outer ring 904 of midplane 902.

Figure 16:
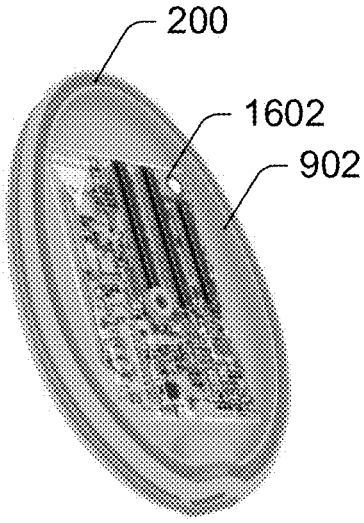
FIG. 16 shows a perspective view of a midplane with an example circuit board integrated on a distal side of the midplane according to one embodiment of the present disclosure.

FIG. 16 shows a perspective view of an example midplane 902 with an example circuit board 1602 integrated on a distal side of midplane 902 according to one embodiment of the present disclosure. In another embodiment, circuit board 1602 may be mounted on either side of midplane 1602.

In various embodiments, circuit board 1602 may include small embedded computer system, such as a CPU and associated integrated circuits, memory, persistent storage, ADC/DAC, voice control ASIC, Bluetooth and USB interconnection circuitry. In addition, expansion boards may be added with additional plug-in capabilities, including, but not limited to: programmable logic (FPGAs), wireless networking, cellular and other radio capabilities, additional persistent storage, graphic screencast capabilities, graphical projection capabilities, sensors for detecting hand/body gestures, hardware encryption, various other sensor capabilities, and other desired features as would be appreciated by those skilled in the art after having the benefit of this disclosure. Multiple expansion boards may be connected and used simultaneously, depending on functionality, available space, and system requirements.

For example, in various embodiments, apparatus 200 includes an integrated circuit board 1602 a small embedded computer system, (CPU and associated integrated circuits, memory, persistent storage, ADC/DAC, power control, battery, wireless battery charging circuitry, voice control ASIC or FPGA installed IP, Bluetooth, USB interconnection circuitry, etc.), multiple speakers and microphones, designed for the purpose of being an in-ear wearable, extendable, modular human/machine interface using voice commands and audio feedback as the primary method of interaction and control.

Additional control is accessible via a secure graphical and/or textual interface running on the device(s) and available via Bluetooth, USB, or any additional networking expansion functionality that may be present on the system, to be accessed and manipulated from another, external device using a graphical or textual interface screen (e.g. such as a client application running on a phone or a computer).

The base computer system mainboard utilizes a modular interconnect system to allow additional interconnect-compatible boards to plug into and extend it, increasing the base compute systems' functionality. The devices (one per ear) can communicate between each other and to other local or remote systems, to negotiate and synchronize their activities, transfer and receive data, and/or leverage provided services, using either and/or both wired or wireless methodologies. Each device (left and right) may contain left and right versions of the same expansion board type where that configuration is appropriate, or employ completely different expansion boards to maximize total wearable-system functionality.

Thus, in various embodiments, the human-ear-wearable apparatus 200 provides an extensible base platform upon which various audio-based input/output methodologies can be integrated in software, firmware, and hardware.

Figure 17:
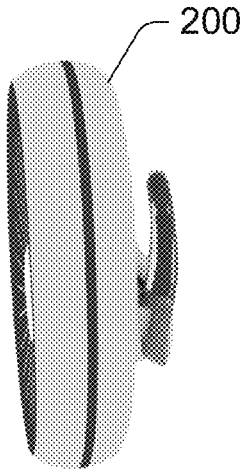
FIG. 17 shows a posterior view of an example human-ear-wearable apparatus.

FIG. 17 shows a posterior view of apparatus 200.

Figure 18:
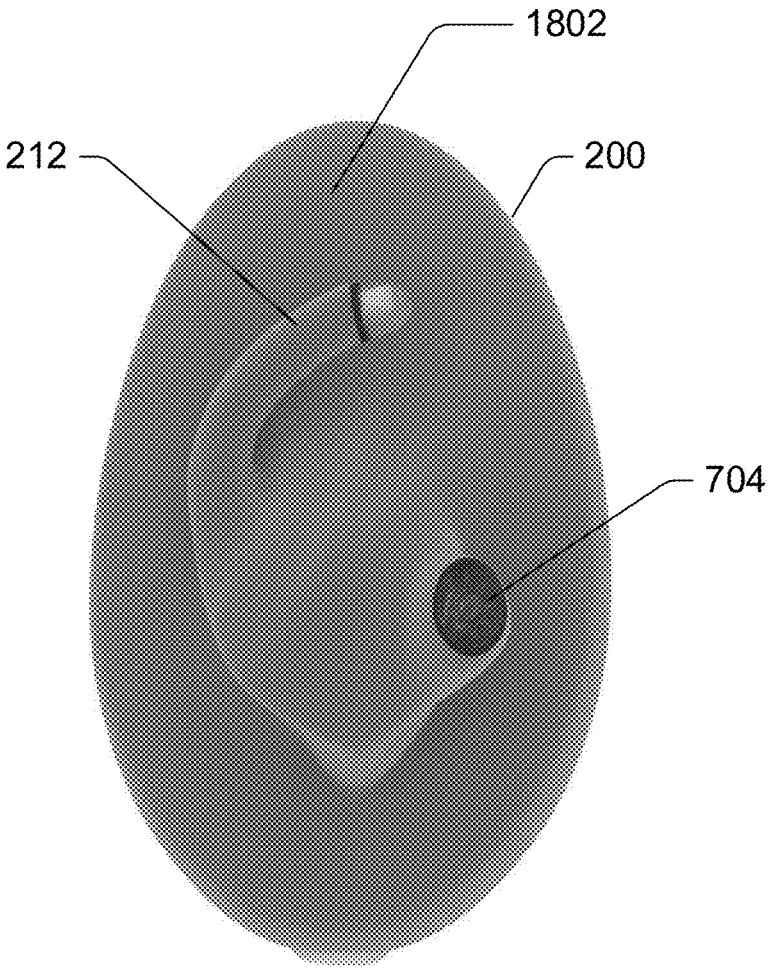
FIG. 18 shows a view of the proximal-side of human-ear-wearable apparatus with an example elastic-comfort sock attached thereto.

FIG. 18 shows a proximal-side view of apparatus 200 with an example elastic-comfort sock 1802 attached thereto. In one embodiment, sock 1802 is configured to attach to a gasket (such as the gasket above) at a midplane meridian and has elastic cuffs to allow the sound producing and receiving areas to be free from coverage, but help to keep the sock in place.

Sock 1802 may be washable and reusable and/or disposable elastic fabric sock that is stretched over and affixed to proximal side. Sock 1802 may be constructed of any suitable fabric such an elastic material similar to that of yoga pants, nylon, stockings, or ballet tights that can be provided in a variety of 'fuzz' densities to allow the user's ear skin surface to breathe, equalize pressure around the bladder, and aid in audio feedback control.

In one embodiment, sock 1802 is reversible, so one shape fits both left and right ear covers. In one embodiment, this sock also has an exterior component that covers over the Pina of the ear, wrapping around the entire ear as a cuff to terminate behind the ear where the ear attaches to the head, acting as an additional device retention system by helping to hold the device securely to Pinna of the ear.

Apparatus 200 may use a wireless charger that uses an ear device-shaped receptacles equipped with sealed electrical coils for the charging of the device batteries, as well as an internal steam generating system that steam-cleans the elastomeric ear bladder between wearing. The system uses a mix of distilled water and isopropyl alcohol as the cleaning agent.

In operation apparatus 200 may be used as a "soundspace." Soundspaces are shared virtual sound rooms. Similar to a conference call, yet fully three dimensional in perceived acoustics. Individuals occupy a position in the space that all members are aware of, and this positional relationship awareness is shared amongst all members of the space. Soundspaces are programmable; shapes, sizes, acoustics, positional data (individual's locations within the room), movement within—these can be exaggerated for effect, and are used like audio emoticons. In fact, you can completely speak through these personas, or themes—in character if you will. You can 'whisper' to someone in the room and only they can hear it. You can 'zoom' into someone and it sonically appears as if the person is flying right up to your ear as they speak. You can be a member of any number of soundspaces at any given time.

Any user of a soundspace can share with the room any input or output they are receiving or outputting, allowing all members to hear the ambient sound of a particular location, or any other sounds the user is actively experiencing. Uses for these soundspaces are many, but a small sampling might include:

(a) Construction workers maintaining hands-free real-time communication (crane operator and high-rise steel workers).

(b) First responders able to stay in constant hands-free communication in visually impaired environments (fire, smoke, etc.).

(C) Remote learning and training situations.

(D) Military squad communications.

(E) TV reports, broadcastors, and anchors.

These spaces may be either centrally managed (e.g. a shared server provides connectivity) which is optimal for widely dispersed participants, or fully distributed (e.g. only the members of the room are part of the communication) which is optimal when proximity allows and/or security dictates Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A human-ear-wearable apparatus, comprising:

a housing configured to contain electronic and audio components;

a mounting system configured to secure the housing to the human ear, the mounting system includes an elastomeric bladder configured to inflate into a customizable counterpart shape of areas of the Concha and Meatus of the human ear; and a pump, coupled to the housing, configured to pass air through an opening in the housing to the elastomeric bladder, wherein inflation of the bladder, via the pump, is controllable by a user to form a customized fit of the mounting system's bladder to the Concha and Meatus areas of the user's ear, wherein at least a portion of the electronic and audio components are encased inside of the elastomeric bladder, and wherein the elastomeric bladder is substantially waterproof.

2. The human-ear-wearable apparatus of claim 1, wherein the housing includes a proximal-side cover configured to rest against the external human ear; and wherein the elastomeric bladder, is disposed at least partially in the housing, wherein the elastomeric bladder has outer walls configured to form:

(a) a finger-like projectile that extends through an opening in the proximal-side cover in response to air pumped into the bladder, wherein air pumped into the bladder expands the finger-like projectile longitudinally along a length of the finger-like projectile and laterally across a width of the finger-like projectile thereby increasing the length and width of the finger-like projectile to an inflated configuration, wherein when the proximal-side cover is positioned against the human ear, and the bladder inflates in response to air pumped into the bladder, the bladder transitions from a deflated configuration to an inflated configuration, and the finger-like projectile extends lengthwise into the auditory meatus of the human ear, and also expands diametrically toward the walls of the ear canal to apply an expansive force against the walls of the ear canal; and (b) an arc-shaped outer wall that extends through an opening in the cover, and expands radially in a generally opposite direction of the finger-like projectile when the bladder is inflated with air, wherein the arc-shaped outer wall is configured to align with a posterior-auricular-sulcus area of the human ear, wherein when the proximal-side cover is positioned against the human ear, and the bladder inflates in response to air pumped into the bladder, the bladder transitions from a deflated configuration to an inflated configuration, and the arc-shaped outer wall expands to apply a force against a posterior-auricular-sulcus area of the human ear.

3. The human-ear-wearable apparatus of claim 2, further comprising: a resilient member disposed in the finger-like projectile, configured to retract the finger-like projectile to a substantially decreased length when the bladder is deflated and transitions to the deflated configuration.

4. The human-ear-wearable apparatus of claim 2, further comprising a speaker mounted in the finger-like projectile of the elastomeric bladder.

5. The human-ear-wearable apparatus of claim 2, further comprising a stalk extending from the elastomeric bladder in a curved direction mirror opposite to the finger-like projectile when the finger-like projectile is in an inflated configuration.

6. The human-ear-wearable apparatus of claim 2, further comprising a stalk extending from the bladder in a curved direction mirror opposite to the finger-like projectile when the finger-like projectile is in an inflated configuration, wherein when the proximal-side cover is positioned against the human ear the appendage is configured to fit inside the Cymba area of the ear.

7. The human-ear-wearable apparatus of claim 2, further comprising a stalk extending from the bladder in a curved direction mirror opposite to the finger-like projectile when the finger-like projectile is in an inflated configuration, wherein when the proximal-side cover is positioned against the human ear, a distal end of the stalk furthest from the bladder, is configured to fit inside the concha and against the Cymba area of the human ear, wherein the stalk contains a microphone encased in the distal end of the stalk.

8. The human-ear-wearable apparatus of claim 2, further comprising a stalk extending from the bladder in a curved direction mirror opposite to the finger-like projectile when the finger-like projectile is in an inflated configuration, wherein when the proximal-side cover is positioned against the human ear, a distal end of the flexible shaped appendage furthest from the bladder, is configured to fit inside and abut the Cymba area of the human ear, wherein the stalk contains a bendable stalk configured to permit a user to bend the appendage laterally.

9. A human-ear-wearable apparatus, comprising:

a midplane having an outer ring along the periphery of the midplane;

an elastomeric bladder, coupled to the outer ring, wherein the elastomeric bladder is generally coplanar to the midplane, wherein the elastomeric bladder and the midplane are generally spaced apart to form a first chamber for maintaining compressed air, wherein the elastomeric bladder encases electronic and audio components and wherein the elastomeric bladder is generally waterproof; and a diaphragm coupled to the outer ring on an opposite side of the midplane from the elastomeric bladder, wherein the midplane is sandwiched between the diaphragm and elastomeric bladder, wherein the diaphragm is generally coplanar to the midplane, and wherein the diaphragm and the midplane are generally spaced apart to form a second chamber.

10. The apparatus of claim 9, wherein the midplane includes a one-way valve extending through the midplane between the second chamber and the first chamber, wherein the one-way valve is configured to permit air to flow from the second chamber into the first chamber, when the diaphragm is compressed.

11. The apparatus of claim 9, further comprising a relief valve positioned in an aperture extending through the outer ring configured to allow pressurized air trapped in the first chamber to escape the enclosed-sealed chamber.

12. The apparatus of claim 9, further comprising a speaker located in the enclosed-sealed chamber.

13. The apparatus of claim 9, further comprising a processor coupled to the midplane.

14. The apparatus of claim 9, further comprising a power source coupled to the midplane.

15. The apparatus of claim 9, wherein the ring is generally circular in shape.

16. The apparatus of claim 9, further comprising a cover to fit over the elastomeric bladder, the cover having openings; wherein the elastomeric bladder is configured to extend through the openings in the cover when the elastomeric bladder is inflated.

17. The apparatus of claim 9, wherein the diaphragm includes at least one integrated duckbill-style-elastomeric-intake valve.

18. The apparatus of claim 9, wherein the diaphragm includes a retained and venting/sealing plug.

* * * * *